US007780213B2

(12) United States Patent
Kim

(10) Patent No.: US 7,780,213 B2
(45) Date of Patent: Aug. 24, 2010

(54) HEAVY EQUIPMENT HAVING TOOL BOX OPENING IN FORWARD DIRECTION OF THE EQUIPMENT

(75) Inventor: Sang Deuk Kim, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 12/236,713

(22) Filed: Sep. 24, 2008

(65) Prior Publication Data

US 2009/0084004 A1 Apr. 2, 2009

(30) Foreign Application Priority Data

Oct. 2, 2007 (KR) ..... 10-2007-0099269

(51) Int. Cl.
*B60R 9/02* (2006.01)

(52) U.S. Cl. ..... 296/37.6; 37/466

(58) Field of Classification Search ..... 37/466, 37/468; 296/37.6, 100.02–100.1, 136.03, 296/136.04, 37.1, 37.8, 37.14; 224/404, 224/281, 42.42, 273, 282, 410, 547, 557, 224/567; 180/65, 68.5; 280/163, 164.1
See application file for complete search history.

(56) References Cited

U.S. PATENT DOCUMENTS 5,439,150 A * 8/1995 Trahms ..... 224/404
6,340,191 B1 * 1/2002 Brady ..... 296/37.6
6,929,303 B1 * 8/2005 Sharples ..... 296/37.6
7,237,636 B2 * 7/2007 Ruppert et al. ..... 180/89.17

* cited by examiner

*Primary Examiner*—Robert E Pezzuto
(74) *Attorney, Agent, or Firm*—Ladas and Parry LLP

(57) ABSTRACT

Heavy equipment having a tool box opening in forward direction of the equipment is provided, in which a tool box door mounted on an upper frame of an excavator can be simply opened and closed through pressing of a button, an auxiliary structure, such as a handrail that is used when an operator ascent toward an engine room, is not required, and the shape of the tool box door can be freely designed to sufficiently secure storage space. The heavy equipment includes a lower driving structure; an upper frame mounted on the lower driving structure to be swiveled; a cap and an engine room mounted in front and in the rear of the upper frame; working devices including a boom fixed to the upper frame, an arm, a bucket, and hydraulic cylinders for driving the boom, the arm, and the bucket, respectively; a counter weight mounted in the rear of the upper frame to keep the balance of the equipment during working; a tool box door mounted on the upper frame to open from the rear to the front side of the equipment, and forming storage space; and a gas spring for opening the tool box door when a button mounted on an external surface of the tool box door is pressed.

5 Claims, 4 Drawing Sheets

HEAVY EQUIPMENT HAVING TOOL BOX OPENING IN FORWARD DIRECTION OF THE EQUIPMENT

CROSS-REFERENCE TO RELATED APPLICATION

This application is based on and claims priority from Korean Patent Application No. 10-2007-0099269, filed on Oct. 2, 2007 in the Korean Intellectual Property Office, the disclosure of which is incorporated herein in its entirety by reference.

BACKGROUND OF THE INVENTION

1. Field of the Invention

The present invention relates to heavy equipment having a tool box opening in forward direction of the equipment, in which a toll box door mounted on an upper frame can be easily opened and closed, and an auxiliary structure, such as a handrail that is used when an operator ascent toward an engine room, is not required to reduce the manufacturing cost.

More particularly, the present invention relates to heavy equipment having a tool box opening in forward direction of the equipment, in which a tool box door can be simply opened and closed through pressing of a button, and the shape of the tool box door can be freely designed to sufficiently secure storage space.

2. Description of the Prior Art

As illustrated in FIG. 1, a caterpillar excavator includes a lower driving structure 1; an upper frame 2 mounted on the lower driving structure 1 to be swiveled; a cap 3 and an engine room 4 mounted in front and in the rear of the upper frame 2; working devices 11 including a boom 5 fixed to the upper frame 2, an arm 6, a bucket 7, and hydraulic cylinders 8, 9, and 10 for driving the boom, the arm, and the bucket, respectively; and a counter weight 12 mounted in the rear of the upper frame 2 to keep the balance of the equipment during working.

As illustrated in FIG. 1, in a conventional tool box for heavy equipment, a tool box door 13 is mounted on the upper frame 2 to open from the front to the rear side of the equipment, and a hand rail 16 and an anti-slip plate 17 are installed so that an operator can safely ascend and descend by stepping on the tool box door 13.

In the drawing, unexplained reference numeral "14" denotes a catch for detachably fixing the tool box door 13 to a tool box body 15 so as to prevent the movement and vibration of the tool box door 13 during traveling or working of the equipment.

In the conventional tool box structure, in order to repair or replace a component installed in the engine room 4 for the purpose of checking the performance of the corresponding component, an operator should step on the tool box door 13 to ascend toward the engine room 4. In this case, it is required that separate auxiliary structures, such as the hand rail 16, the anti-slip plate 17, and the like, are used, and this causes the manufacturing cost to be increased.

Also, when an operator ascends toward the engine room 4, the tool box door 13 is used as a movement path, and thus an upper surface of the tool box door 13, on which an operator steps, is kept as a plane while a section of the tool box is in the form of steps. Accordingly, the tool box door 13 is mounted on the upper frame 2 with limited size and shape.

Also, since the tool box door 13 opens from the front to the rear of the equipment (i.e. it opens from the bottom to the upside of the equipment), the tool box door 13 is restricted by structure when it is mounted on the upper frame 2.

Also, after the catch 14 is unlocked, the tool box door 13 may be simply opened at any time, contrary to the operator's intention, and this may cause the damage of the tool box door.

SUMMARY OF THE INVENTION

Accordingly, the present invention has been made to solve the above-mentioned problems occurring in the prior art, and an object of the present invention is to provide heavy equipment having a tool box opening in forward direction of the equipment, in which a tool box door mounted on an upper frame can be opened and closed using a button and a gas spring, and the shape of the tool box door can be freely designed to sufficiently secure storage space, so that convenience can be provided to a user.

Another object of the present invention is to provide heavy equipment having a tool box opening in forward direction of the equipment, in which an operator can ascend toward an engine room without stepping on a tool box door to prevent the damage and deformation of the tool box door, and an auxiliary structure, such as a handrail, an anti-slip plate, and the like, is unnecessary to reduce the manufacturing cost.

In order to accomplish these objects, there is provided heavy equipment having a tool box opening in forward direction of the equipment, according to an embodiment of the present invention, which includes a lower driving structure; an upper frame mounted on the lower driving structure to be swiveled; a cap and an engine room mounted in front and in the rear of the upper frame; working devices including a boom fixed to the upper frame, an arm, a bucket, and hydraulic cylinders for driving the boom, the arm, and the bucket, respectively; a counter weight mounted in the rear of the upper frame to keep the balance of the equipment during working; a tool box door mounted on the upper frame to open from the rear to the front side of the equipment, and forming storage space; and a gas spring for opening the tool box door when a button mounted on an external surface of the tool box door is pressed.

The equipment according to an embodiment of the present invention may further include a damping elastic member for preventing an abrupt opening of the tool box door when the tool box door is opened by the gas spring.

The equipment according to an embodiment of the present invention may further include a protection member mounted on the upper frame to prevent the gas spring and the damping elastic member from being damaged by an external impact.

The equipment according to an embodiment of the present invention may further include a foothold for ascending and descending formed on the upper frame so that an operator can ascend to the engine room through stepping on the foothold when the tool box door is opened.

The equipment according to an embodiment of the present invention may further include a handle for ascending and descending formed on one side of the foothold.

The equipment according to an embodiment of the present invention may further include an embossing part formed to project from an upper surface of the foothold to prevent slipping during ascending or descending.

Through holes may be formed on the embossing part.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 2:
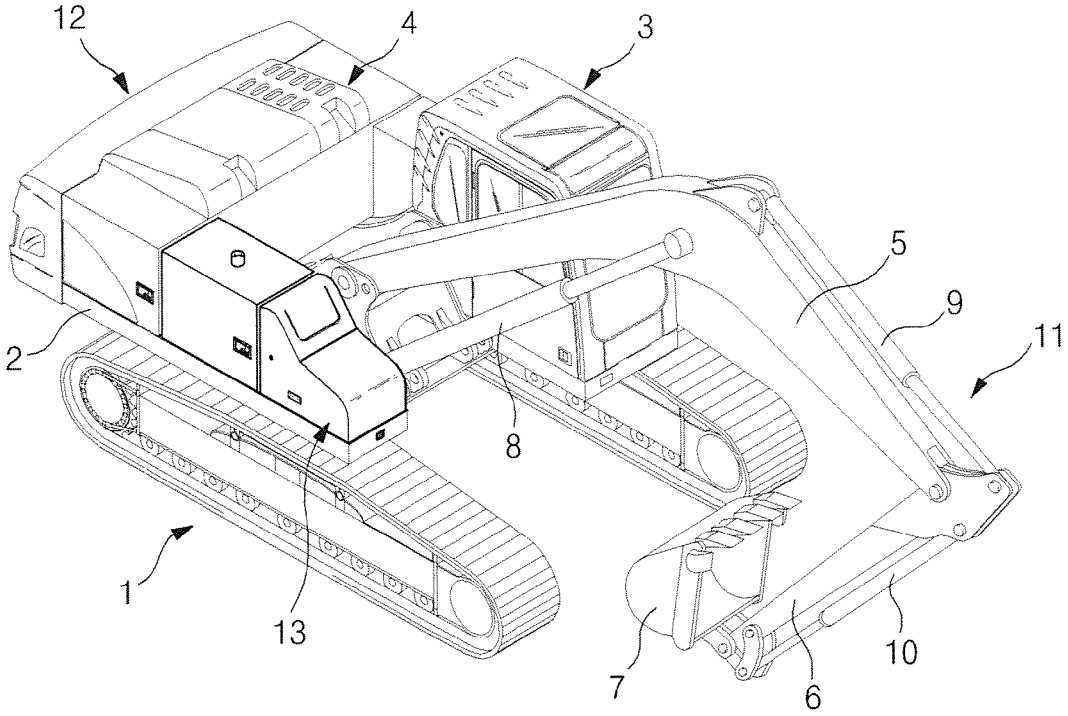
FIG. 2 is a view illustrating the use state of heavy equipment having a tool box opening in forward direction of the equipment according to an embodiment of the present invention.
Figure 3:
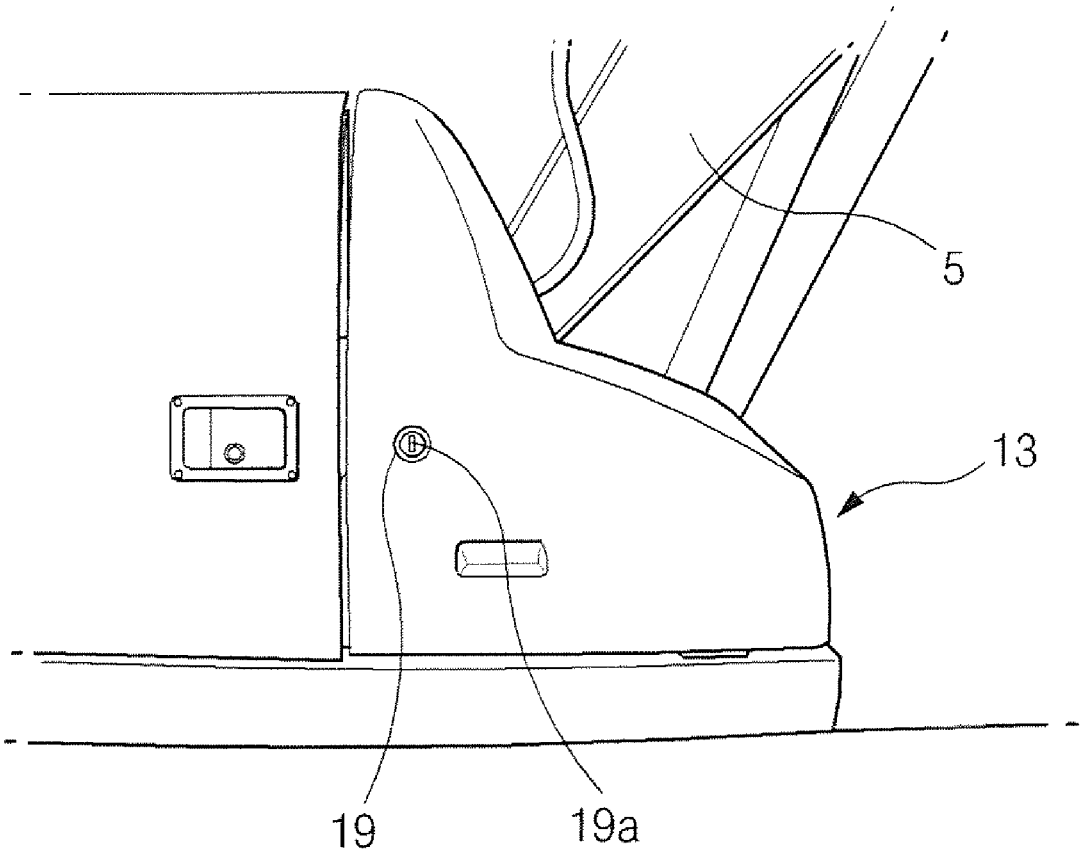
FIG. 3 is a schematic view illustrating the closed state of a tool box door as illustrated in FIG. 2.
Figure 4:
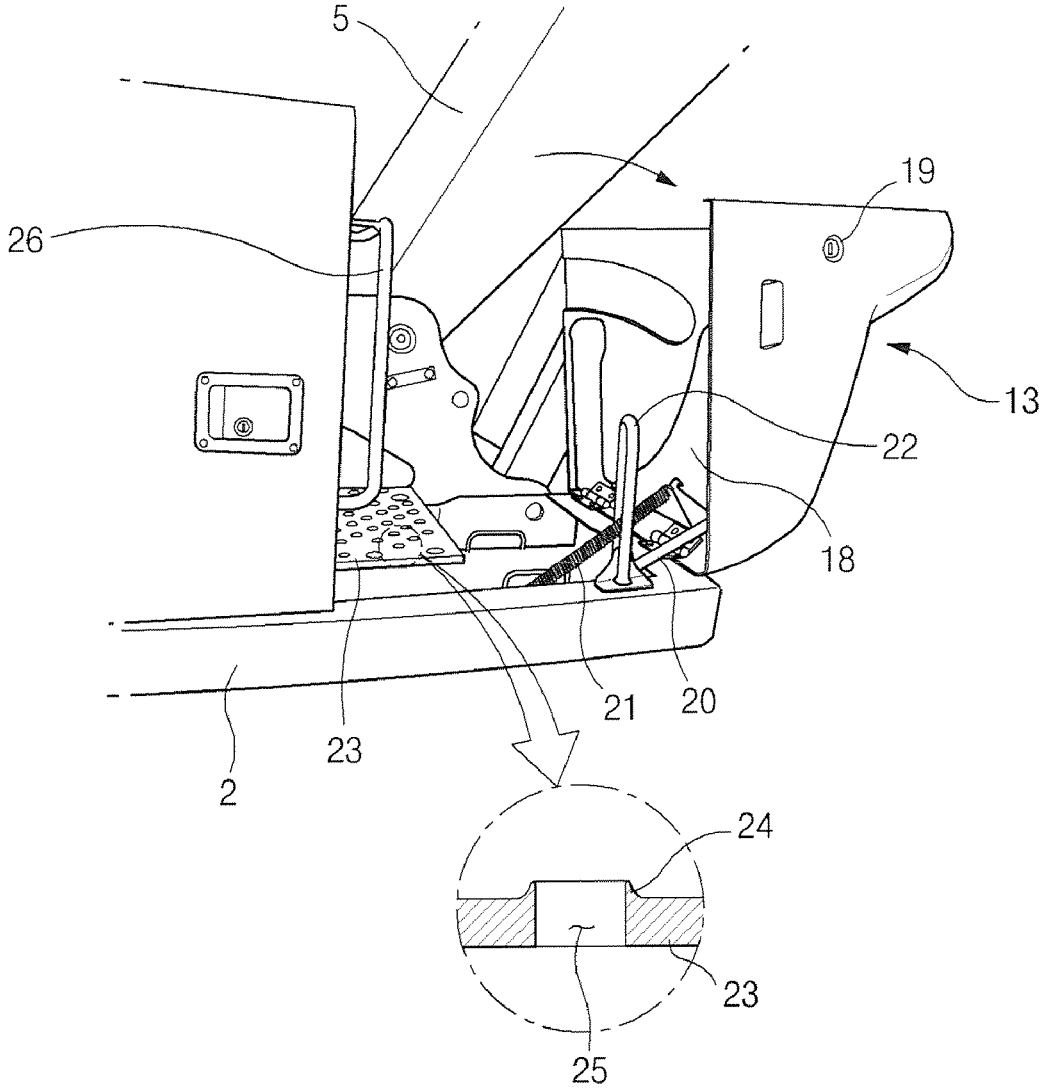
FIG. 4 is a view illustrating the open state of a tool box door as illustrated in FIG. 2.

As shown in FIGS. 2 to 4, heavy equipment having a tool box opening in forward direction of the equipment according to an embodiment of the present invention includes a lower driving structure 1; an upper frame 2 mounted on the lower driving structure 1 to be swiveled; a cap 3 and an engine room 4 mounted in front and in the rear of the upper frame 2; working devices 11 including a boom 5 fixed to the upper frame 2, an arm 6, a bucket 7, and hydraulic cylinders 8, 9, and 10 for driving the boom, the arm, and the bucket, respectively; a counter weight 12 mounted in the rear of the upper frame 2 to keep the balance of the equipment during working; a tool box door 13 mounted on the upper frame 2 to open from the rear to the front side of the equipment, and forming storage space 18; and a gas spring 20 for opening the tool box door 13 when a button 19 mounted on an external surface of the tool box door 13 is pressed.

The equipment according to an embodiment of the present invention further includes a damping elastic member 21 (e.g. a tension spring) for preventing an abrupt opening of the tool box door 13 when the tool box door 13 is opened by the gas spring 20.

The equipment according to an embodiment of the present invention further includes a protection member and an auxiliary handle 22 mounted on the upper frame 2 to prevent the gas spring 20 and the damping elastic member 21 from being damaged by an external impact.

The equipment according to an embodiment of the present invention further includes a foothold 23 for ascending and descending formed on the upper frame 2 so that an operator can ascend to the engine room 4 through stepping on the foothold 23 when the tool box door 13 is opened.

The equipment according to an embodiment of the present invention further includes an embossing part 24 formed to project from an upper surface of the foothold 23 to prevent slipping during ascending or descending.

Through holes 25 are formed on the embossing part 24.

The equipment according to an embodiment of the present invention further includes a handle 26 for ascending and descending formed on one side of the foothold 23 (or fixed to a side surface of a hydraulic fluid tank).

Figure 1:
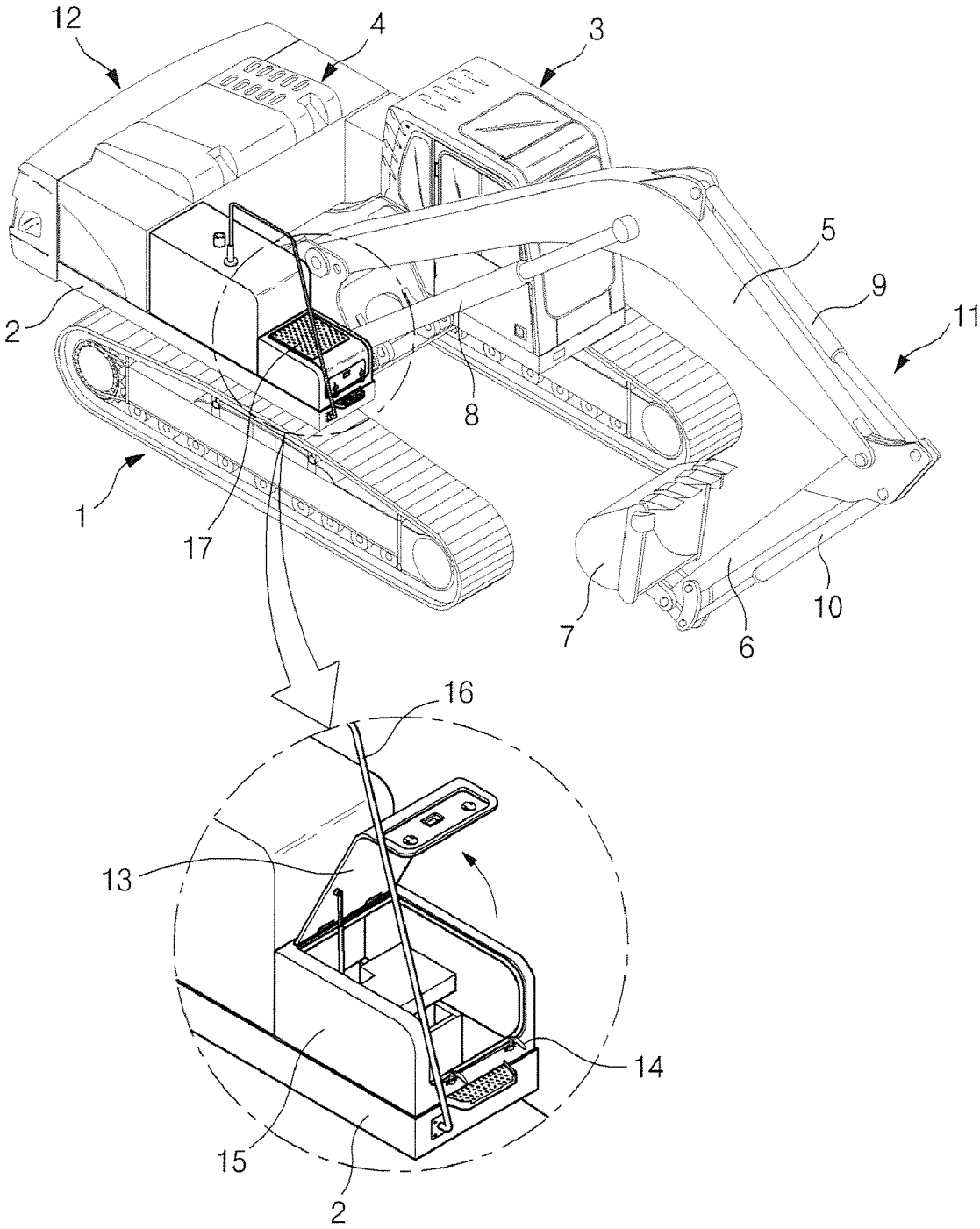
Fig. 1 Prior Art
FIG. 1 is a perspective view of a caterpillar excavator.

Since the construction including the lower driving structure 1, the upper frame 2, the engine room 4, the working devices 11, and the like, is substantially the same as that as illustrated in FIG. 1, the detailed description thereof will be omitted. In the description of the present invention, the same drawing reference numerals are used for the same elements among/across various figures.

Hereinafter, the operation of the heavy equipment having a tool box opening in forward direction of the equipment according to an embodiment of the present invention will be described with reference to accompanying drawings.

As illustrated in FIG. 4, when an operator ascends to an upper part of the engine room 4 in order to confirm the performance of a hydraulic pump and so on installed in the engine room 4 or to repair or replace the corresponding component, the gas spring 20 is extended during the pressing of the button 19 installed on the outer surface of the tool box door 13, and thus the tool box door 13 is rotated (clockwise) around a hinge part (e.g. a hinge) fixed to the upper frame 2, and thus the tool box door 13 is opened from the rear to the front side of the equipment.

At this time, the tool box door 13, which is opened by the gas spring 20, is prevented from being abruptly opened by a tension force of the elastic member (e.g. tension spring) 21.

Accordingly, the operator can ascend to an upper part of the engine room 4 by stepping on the lower driving structure 1 and the foothold 23 installed on the upper frame 2 in order. In this case, the operator can hold on to the handle 26 installed on one side of the foothold 23, the protection member, and the auxiliary handle 22 to keep safely in ascending.

In the case of ascending the engine room 4 in the winter season or in the rainy season, the operator is prevented from slipping on the foothold 23 by the embossing part 24 projected from the upper surface of the foothold 23 and the through holes 25 formed in the center of the embossing part 24.

In the case of closing the tool box door 13, the foothold 23 and the handle 26 for ascending and descending are accommodated and concealed in the storage space 18 of the tool box door 13. Accordingly, it is restricted for the operator to ascend to the upper part of the engine room 4 by stepping on the tool box contrary to the operator's intention.

On the other hand, as the "∩"-shaped protection member and the auxiliary handle 22 are installed on the outside of the elastic member 21 and the gas spring 20, the elastic member 21 and the gas spring 20 are prevented from being damaged by an external impact. Also, in the case of ascending toward the engine room 4 by stepping on the lower driving structure 1, the operator can hold on to the protection member and the auxiliary handle 22 to keep safety in ascending.

As the tool box door 13 is opened toward the equipment by the gas spring 20 as described above, extended storage space 18 can be secured. Voluminous tool box and so on can be accommodated in the storage space 18 to provide convenience to the operator.

Since it is possible for the operator to ascend to the upper part of the engine room 4 without stepping on the tool box door 13 (i.e. the tool box door 13 does not serve as a foothold), the tool box door 13 can be prevented from being damaged or deformed.

Also, the size and shape of the tool box door 13 mounted on the upper frame 2 can be freely changed, and thus the external appearance of the whole equipment can be improved.

On the other hand, by manipulating a key coupled to a key insertion hole 19*a* formed in the center of the button 19, the tool box door 13 can be locked. Accordingly, even in the case of pressing the button 19, the gas spring 20 is prevented from being extended, and thus the tool box door 13 cannot be opened.

As described above, the heavy equipment having a tool box opening in forward direction of the equipment has the following advantages.

The tool box door mounted on the upper frame can be opened and closed by the button and the gas spring, and the shape of the tool box door can be freely designed to sufficiently secure storage space, so that convenience can be provided to a user.

In addition, the operator can ascend toward the engine room without directly stepping on the tool box door to prevent the damage and deformation of the tool box door and to lengthen the life span of the tool box door, and an auxiliary structure for safety, such as a handrail, an anti-slip plate, and the like, is unnecessary to reduce the manufacturing cost.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. Heavy equipment having a tool box opening in a forward direction of the equipment, comprising:

a lower driving structure;

an upper frame mounted on the lower driving structure to be swivelled;

a cap mounted in front and an engine room mounted in the rear of the upper frame, respectively;

working devices including a boom fixed to the upper frame, an arm, a bucket, and hydraulic cylinders for driving the boom, the arm, and the bucket, respectively;

a counter weight mounted in the rear of the upper frame to keep the balance of the equipment during working;

a tool box door mounted on the upper frame to open from the rear to the front side of the equipment, and forming storage space;

a gas spring for opening the tool box door when a button mounted on an external surface of the tool box door is pressed;

and further comprising a damping elastic member for preventing an abrupt opening of the tool box door when the tool box door is opened from the rear to the front side of the equipment by the gas spring; and a protection member and an auxiliary handle mounted on the upper frame to prevent the gas spring and the damping elastic member from being damaged by an external impact.

2. The heavy equipment of claim 1, further comprising a foothold for ascending and descending formed on the upper frame so that an operator can ascend to the engine room by stepping on the foothold when the tool box door is opened.

3. The heavy equipment of claim 2, further comprising a handle for ascending and descending formed on one side of the foothold.

4. The heavy equipment of claim 3, further comprising an embossing part formed to project from an upper surface of the foothold to prevent slipping during ascending or descending.

5. The heavy equipment of claim 4, wherein through holes are formed on the embossing part.

* * * * *